US006837221B2

(12) United States Patent
Crofts et al.

(10) Patent No.: US 6,837,221 B2
(45) Date of Patent: Jan. 4, 2005

(54) FUEL INJECTOR WITH FEEDBACK CONTROL

(75) Inventors: John D. Crofts, Edinburgh, IN (US); Arthur C. Truman, III, Columbus, IN (US); Jung-min C. Sung, Columbus, IN (US); Peter Rauznitz, Columbus, IN (US)

(73) Assignee: Cummins Inc., Columbus, IN (US)

( * ) Notice: Subject to any disclaimer, the term of this patent is extended or adjusted under 35 U.S.C. 154(b) by 202 days.

(21) Appl. No.: 10/179,017

(22) Filed: Jun. 26, 2002

(65) Prior Publication Data

US 2003/0106533 A1 Jun. 12, 2003

Related U.S. Application Data

(63) Continuation-in-part of application No. 10/011,462, filed on Dec. 11, 2001, now abandoned.

(51) Int. Cl.[7] ..... F02M 37/04
(52) U.S. Cl. ..... 123/467; 123/496
(58) Field of Search ..... 123/467, 500, 123/501, 446, 496

(56) References Cited

U.S. PATENT DOCUMENTS

| | | | | |
|---|---|---|---|---|
| 3,927,652 A | | 12/1975 | O'Neill | |
| 4,098,560 A | | 7/1978 | O'Neill | |
| 4,359,032 A | * | 11/1982 | Ohie | 123/458 |
| 4,499,878 A | | 2/1985 | Igashira et al. | |
| 4,608,958 A | | 9/1986 | Sakakibara et al. | |
| 4,649,886 A | | 3/1987 | Igashira et al. | |
| 4,688,536 A | | 8/1987 | Mitsuyasu et al. | |
| 4,722,310 A | | 2/1988 | Igashira et al. | |
| 4,966,119 A | | 10/1990 | Mitsuyasu et al. | |
| 5,053,668 A | | 10/1991 | Mitsuyasu | |
| 5,057,734 A | | 10/1991 | Tsuzuki et al. | |
| 5,156,132 A | * | 10/1992 | Iwanaga | 123/496 |
| 5,477,834 A | | 12/1995 | Yoshizu | |
| 5,479,902 A | | 1/1996 | Wirbeleit et al. | |
| 5,605,134 A | | 2/1997 | Martin | |
| 5,711,277 A | | 1/1998 | Fuseya | |
| 5,713,326 A | | 2/1998 | Huber | |
| 5,779,149 A | | 7/1998 | Hayes, Jr. | |
| 5,803,361 A | | 9/1998 | Horiuchi et al. | |
| 5,819,704 A | | 10/1998 | Tarr et al. | |
| 5,819,710 A | | 10/1998 | Huber | |
| 5,860,597 A | | 1/1999 | Tarr | |
| 5,884,611 A | | 3/1999 | Tarr et al. | |
| 5,884,848 A | | 3/1999 | Crofts et al. | |
| 5,913,300 A | * | 6/1999 | Drummond | 123/467 |
| 5,941,215 A | | 8/1999 | Augustin | |
| 5,979,803 A | | 11/1999 | Peters et al. | |
| 5,988,142 A | | 11/1999 | Klopfer | |
| 6,145,492 A | * | 11/2000 | Lixl | 123/467 |
| 6,168,132 B1 | | 1/2001 | Frank et al. | 123/467 |
| 6,209,524 B1 | | 4/2001 | Itoh | 123/467 |
| 6,237,570 B1 | * | 5/2001 | Aoki et al. | 123/467 |

(List continued on next page.)

*Primary Examiner*—Carl S. Miller
(74) *Attorney, Agent, or Firm*—Nixon Peabody LLP; Tim L. Brackett, Jr.; J. Bruce Schelkopf

(57) ABSTRACT

An injector is provided which includes a nozzle valve element, a control volume, and an injection control valve including a control valve member for controlling fuel flow from the control volume so as to control nozzle valve movement. Importantly, the injector includes a nozzle valve lift detecting device for detecting nozzle valve lift and providing a nozzle valve element lift feedback signal. Feedback signals are improved and control valve member oscillations are minimized by positioning a valve seat associated with the control valve member a spaced distance from the control volume, positioning a drain orifice such that the nozzle valve element restricts flow through a drain circuit when in an open position and extending the control valve member from the valve seat to the control volume to form an end wall of the control volume.

17 Claims, 4 Drawing Sheets

U.S. PATENT DOCUMENTS 6,244,250 B1 6/2001 Hlousek ..... 123/467
6,253,736 B1 * 7/2001 Crofts et al. ..... 123/498
6,293,254 B1 * 9/2001 Crofts et al. ..... 123/467
6,328,017 B1 12/2001 Heinz et al. ..... 123/467
6,340,018 B1 1/2002 Mattes ..... 123/467
6,374,802 B1 * 4/2002 Boecking ..... 123/446
6,499,467 B1 * 12/2002 Morris et al. ..... 123/467

* cited by examiner

FUEL INJECTOR WITH FEEDBACK CONTROL

REFERENCE TO RELATED APPLICATIONS

This application is a continuation-in-part of application Ser. No. 10/011,462, filed Dec. 11, 2001 now abandoned.

TECHNICAL FIELD

The invention relates to an improved fuel injector which effectively controls fuel metering by providing a feedback signal indicative of valve movement.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection.

In another type of system, such as disclosed in U.S. Pat. No. 5,819,704, the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve.

Internal combustion engine designers have increasingly come to realize that substantially improved fuel supply systems are required in order to meet the ever increasing governmental and regulatory requirements of emissions abatement and increased fuel economy. Specifically, it is well known that improved control of fuel metering, i.e. the rate of fuel flow into the combustion chamber, is essential in reducing the level of emissions generated by the diesel fuel combustion process while minimizing fuel consumption. As a result, many proposals have been made to provide metering, or injection rate, control devices in closed nozzle fuel injector systems. U.S. Pat. No. 5,779,149 to Hayes, Jr. discloses a piezoelectric controlled common rail injector of the servo-controlled type. The piezoelectric actuator controls the movement of an inwardly opening poppet-type control valve for controlling the flow of fuel from a control volume and ultimately the movement of the nozzle valve element. Fuel metering is variably controlled by controlling the duration and modulation of the electrical signal provided to the actuator. U.S. Pat. No. 5,713,326 to Huber discloses a similar injector design. Although these systems provide some control over fuel metering, nozzle valve opening and closing characteristics are sensitive to injection pressure, component tolerances and wear, fuel properties and temperature. Therefore, additional fuel metering control is desirable.

U.S. Pat. No. 5,860,597 to Tarr discloses a servo-controlled nozzle assembly for a fuel injector which operates to effectively control and vary the rate of fuel injection. The assembly includes a control valve element positioned in a control volume for cooperating with the needle valve element to control the drain flow of fuel through the drain circuit. Specifically, positioning of the control valve element relative to the valve surface controls drain flow through the drain circuit. A fast proportional actuator is used to permit selective controlled movement of the control valve element in proportion to the magnitude of the input signal to the actuator. However, this design does not offer any feedback information on actual valve lift which can be used for metering control. In addition, the control valve element engages a valve seat formed on the movable needle valve element and therefore may provide insufficient sealing in all situations as compared to a stationary valve seat.

U.S. Pat. No. 6,253,736 to Crofts et al. discloses a servo-controlled fuel injector nozzle assembly having feedback control. The injector includes a piezoelectric actuator for controlling a valve member controlling fuel flow from a control volume positioned adjacent one end of a needle valve element to thereby control movement of the needle valve element. However, reductions in control valve member oscillations and improvements in the feedback signal are desirable.

Therefore, there is a need for a simple, improved fuel injector which is capable of effectively controlling fuel metering by sensing needle valve lift.

SUMMARY OF THE INVENTION

It is, therefore, one object of the present invention to overcome the deficiencies of the prior art and to provide a fuel injector nozzle assembly which better enables the engine to meet future diesel engine exhaust emission requirements while minimizing fuel consumption.

Another object of the present invention is to provide a fuel injector having improved control of fuel metering and rate shaping.

Yet another object of the present invention is to provide a fuel injector which permits the nozzle valve opening and closing characteristics to be more easily tailored as desired.

Still another object of the present invention is to provide a fuel injector having a nozzle assembly capable of compensating for changes in injection pressure, component tolerances and wear, fuel properties, temperature and other "noises" which alter the lift characteristics of the nozzle valve.

It is yet another object of the present invention to provide a fuel injector having a nozzle assembly capable of sensing nozzle valve lift to provide a feedback signal to enhance fuel metering control.

Still another object of the present invention is to provide a fuel injector having a control valve, which reduces control valve member oscillations, especially during opening.

Yet another object of the present invention is to provide a fuel injector having a control valve and a system capable of detecting, and providing feedback signals relating to, control valve opening and closing.

It is yet another object of the present invention to provide a fuel injector having a nozzle assembly capable of sensing both initial opening of the nozzle valve and opening into a full open position to provide a feedback signal to enhance fuel metering control.

A still further object of the present invention is to provide a fuel injector which is capable of accurately and variably controlling the timing of nozzle valve opening and closing, the length of the injection event and the rate at which the nozzle valve opens to provide optimum control over fuel injection metering and rate shaping.

These and other objects are achieved by providing a fuel injector for injecting fuel at high pressure into the combustion chamber of an engine, comprising an injector body containing an injector cavity and an injector orifice communicating with one end of the injector cavity to discharge fuel into the combustion chamber and a nozzle valve element positioned in one end of the injector cavity adjacent the injector orifice. The nozzle valve element is movable between an open position in which fuel may flow through the injector orifice into the combustion chamber and a closed position in which fuel flow through the injector orifice is blocked. The injector also includes a control volume position to receive a pressurized supply of fuel and a drain circuit for draining fuel from the control volume to a low pressure drain. The fuel injector also includes an injection control valve positioned along the drain circuit to control fuel flow from the control volume wherein the injection control valve includes a reciprocally mounted control valve member movable between an open position permitting the flow through the drain circuit and a closed position in sealing abutment against a valve seat to block flow through the drain circuit. The control valve member includes an elongated portion extending from a position adjacent the valve seat toward an upstream portion of the drain circuit. The fuel injector further includes a guide surface formed on the injector body and positioned adjacent the elongated portion of the control valve member to permit relative sliding movement of the elongated portion while guiding the elongated portion. The valve seat may be positioned along the drain circuit a spaced distance from the control volume while the elongated portion of the control valve member extends to a position adjacent the control volume and includes a distal end forming an end wall of the control volume.

The elongated portion may extend axially along the fuel injector body toward the control volume and the guide surface may be cylindrically shaped. The elongated portion may also be cylindrically shaped and extend to a position adjacent the control volume. A portion of the drain circuit may be formed in the control valve member and that portion may include a drain orifice. The portion of the drain circuit extending through the control valve member may include a central passage having a first end positioned in communication with the control volume. The portion of the drain circuit may further include a transverse passage in communication with a second end of the central passage and an annular cavity surrounding the control valve member. The guide surface and the elongated portion may form a partial fluid seal to minimize leakage while permitting smooth reciprocal movement of the control valve member. A nozzle valve element lift detecting device may be included to detect movement of the nozzle valve element into the open position and for providing a nozzle valve element lift feedback signal. The nozzle valve lift detecting device may include a piezoelectric element. Also, the injection control valve may further include a piezoelectric actuator connected to the control valve member. The elongated portion of the control valve member may include a first section for engaging the valve seat and a second section formed separately from the first section wherein the second section contains a drain orifice for restricting drain flow. A control device may be provided to receive the nozzle valve element lift feedback signal and generate an injection control signal based on the nozzle valve element lift feedback signal. The control device may vary the injection control signal based on the nozzle valve element lift feedback signal to vary at least one of a timing of an opening of the injection control valve and a rate of opening of the injection control valve.

DETAILED DESCRIPTION OF THE INVENTION

Figure 1B:
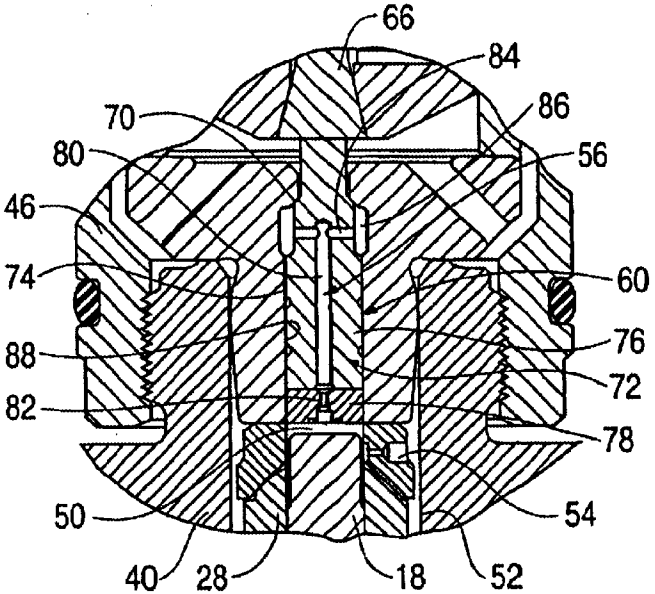
FIG. 1*b* is an expanded cross sectional view of the area A in FIG. 1*a;*
Figure 1C:
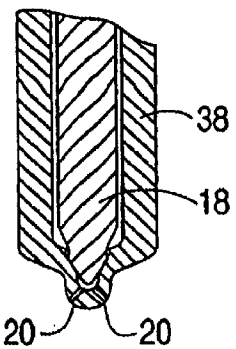
FIG. 1*c* is an expanded cross sectional view of area B in FIG. 1*a;*
Figure 1A:
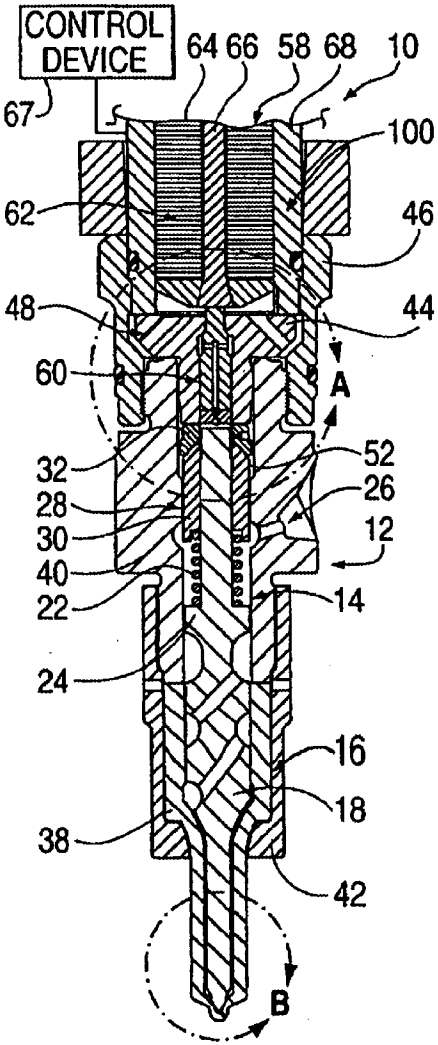
FIG. 1*a* is a cross sectional view of the fuel injector of the present invention.

Referring to FIG. 1*a*, there is shown a closed nozzle fuel injector of the present invention, indicated generally at 10, which functions to effectively permit accurate and variable control of fuel metering by, in part, providing an improved feedback signal for accurate control of fuel metering and delivery. Fuel injector 10 is comprised of an injector body 12 having a generally elongated, cylindrical shape which forms an injector cavity 14. The lower portion of fuel injector body 12 includes a closed nozzle assembly, indicated generally at 16, which includes a nozzle valve element 18 reciprocally mounted for opening and closing injector orifices 20 formed in body 12 thereby controlling the flow of injection fuel into an engine combustion chamber (not shown).

Nozzle valve element 18 is preferably formed from a single integral piece structure and positioned in one end of injector cavity 14. A bias spring 22 is positioned in injector cavity 14 for abutment against a land 24 formed on nozzle valve element 18 so as to bias nozzle valve element 18 into a closed position as shown in FIGS. 1*a* and 1*c*. A high pressure fuel supply passage is formed in injector body 12 for supplying high pressure fuel from a high pressure source to injector cavity 14. The upper end of nozzle valve element 18 is positioned for slideable movement within a sealing and guide sleeve 28. Sealing and guide sleeve 28 includes a first section 30 and a second section 32 positioned in abutment against first section 30. A lower end of first section 30 is positioned for abutment by the upper end of bias spring 22 while the upper end of first section 30 abuts second section 32 so as to maintain the upper end of second section 32 in sealing abutment against injector body 12.

As shown on FIGS. 1*a*–1*c*, injector body 12 includes a nozzle housing 38 for receiving a lower end of nozzle valve element 18 (FIG. 1*c*), a barrel 40 for receiving the upper end of nozzle valve element 18 and a retainer 42 containing internal threads for engaging corresponding external threads on the lower end of barrel 40 to permit the components to be held together in compressive abutting relationship by simple relative rotation of retainer 42 with respect to barrel 40. Injector body 12 further includes a valve support 44 positioned at the upper end of barrel 40 and a connector sleeve 46 for securing valve support 44 as described hereinbelow. Fuel injector 10 further includes a nozzle valve control arrangement indicated generally at 48 for controlling the movement of nozzle element 18 between open and closed positions so as to define an injection event during which fuel flows through injector orifices 20 into the combustion chamber. Specifically, nozzle valve control arrangement 48 operates to initiate the beginning of movement of nozzle valve element 18 from one of its positions to the other while also variably controlling the movement, i.e., rate of movement of nozzle valve element 20 as it moves between open and closed positions and the degree of opening of the nozzle valve element. In this manner, nozzle valve control arrangement 48 functions to control the quantity of fuel metered and also as a rate shaping control device for producing a predetermined time varying change in the flow rate of fuel injected into the combustion chamber during an injection event so as to improve combustion and minimize emissions.

The nozzle assembly of the present invention can be adapted for use with a variety of injectors and fuel systems. For example, closed nozzle injector 10 may receive high pressure fuel from a high pressure common rail or, alternatively, a pump-line-nozzle system or a unit injector system incorporating, for example, a mechanically actuated plunger into the injector body. Thus, the nozzle assembly of the present invention may be incorporated into any fuel injector or fuel system which supplies high pressure fuel to the injector while permitting nozzle valve control arrangement 48 to control the timing, quantity, and rate shape of the fuel injected into the combustion chamber. As most clearly shown in FIG. 1*b*, nozzle control arrangement 48 includes a control volume or cavity 50 formed in injector body 12 at the outer end of a bore 52 extending through barrel 40 in a control charge circuit 54 for directing fuel from supply passage 26 into control volume 50. Nozzle valve control arrangement 48 further includes a drain circuit 56 for draining fuel from control volume 50 and an injection control valve 58 positioned along drain circuit 56 for variably controlling the flow of fuel through drain circuit 56 so as to cause controlled, predetermined movement of nozzle valve element 18.

Injection control valve 58 is specifically designed to enable precise control over the movement of nozzle valve element 18 from its closed to its open position so as to predictably control the flow of fuel through injector orifices 20 for achieving a desired fuel metering and injection rate change. As shown in FIG. 1*a*, injection control valve 58 includes a control valve member 60 and an actuator 62 for selectively moving control valve member 60 through a predetermined variable lift schedule so as to precisely control the movement of nozzle valve element 18. Actuator 62 is preferably a piezo-electric actuator including a columnar laminated body of thin disk-shaped elements 64 each having a piezoelectric effect, a control rod 66 and an actuator housing 68. When a voltage, i.e, +150 volts, is applied to each element, the element expands along the axial direction of the column. Conversely, when a voltage of −150 volts is applied to each element, the element contracts so that the inner end of piezoelectric actuator 62 moves away from closed nozzle assembly 16. The lower end of control rod 66 abuts the upper end of control valve member 60 so that the expansion/contraction of piezoelectric actuator 62 is directly transmitted to control valve member 60 causing control valve member 60 to move between open and closed positions. Piezoelectric actuator 62 may include any type or design of piezoelectric actuator capable of actuating control valve 58 as described hereinbelow. Although actuator 62 is preferably of the piezoelectric type, any type of actuator simply capable of selectively controlling movement of control valve member 60 with a sufficient degree of precision may be used.

It should be noted that the actuation/de-actuation of actuator 62 is controlled by a control device 67, i.e., an electronic control unit which precisely controls both the timing of injection by providing an injection control signal to actuator 62 at a predetermined time during engine operation and the injection rate shape by controllably varying the voltage supply to actuator 62 based on engine operating conditions.

Connector sleeve 46 of injector body 12 contains internal threads at a lower end for engaging complementary external threads formed on barrel 40 and contains internal threads at an upper end for engaging external threads formed on actuator housing 68 so that rotation of connector sleeve 46 can be used to connect actuator housing 68 and thus injection control valve 58 to injector body 12 while securing valve support 46 to barrel 40. A valve seat 70 is formed on valve support 44 along drain circuit 56 a spaced distance from control volume 50 for abutment by control valve member 60. Control valve member 60 includes an upper end positioned in abutment against control rod 66 and a lower end forming an end wall of control volume 50. Control red-valve member 60 includes a generally elongated portion 72 extending from a position adjacent valve seat 70 to the lower end of control valve member 60. Elongated portion 72 may be generally cylindrically shaped and is sized relative to a complementary bore 74 formed in valve support 44 so as to create a substantial fluid seal between the surfaces while permitting smooth sliding movement of control valve member 60 within bore 74. Control valve member 60 may be formed from a single piece of material or may include, as shown in FIG. 1*b*, a first section 76 and second section 78 positioned in abutment against first section 76 and forming the end wall of control volume 50. Importantly, drain circuit 56 is formed in control valve member 60 and includes a central passage 80 formed in elongated portion 72 and therefore formed in first section 76 and second section 78. Preferably, central passage 80 includes a drain orifice 82 designed with a larger cross sectional flow area than a similar orifice formed in control volume charge circuit 54 to cause a greater amount of fuel to be drained from control volume 50 than is replenished via control volume charge circuit 54 upon opening of injection control valve 58 as discussed hereinbelow. Drain circuit 56 also includes a transfer passage 84 in communication with an upper end of central passage 80 and an annular cavity 86 positioned adjacent to valve seat 70. Thus, when control valve member 60 moves into an open position, fuel from control volume 50 flows through central passage 80 and transfer passage 84 into annular cavity 86 and through the valve opening at valve seat 70 onward to a low pressure drain. Valve support 44 includes an annular guide surface 88 positioned adjacent elongated portion 72 of control valve member 60 to permit relevant sliding movement of elongated portion 72 while also guiding control valve member 60.

Figure 4:
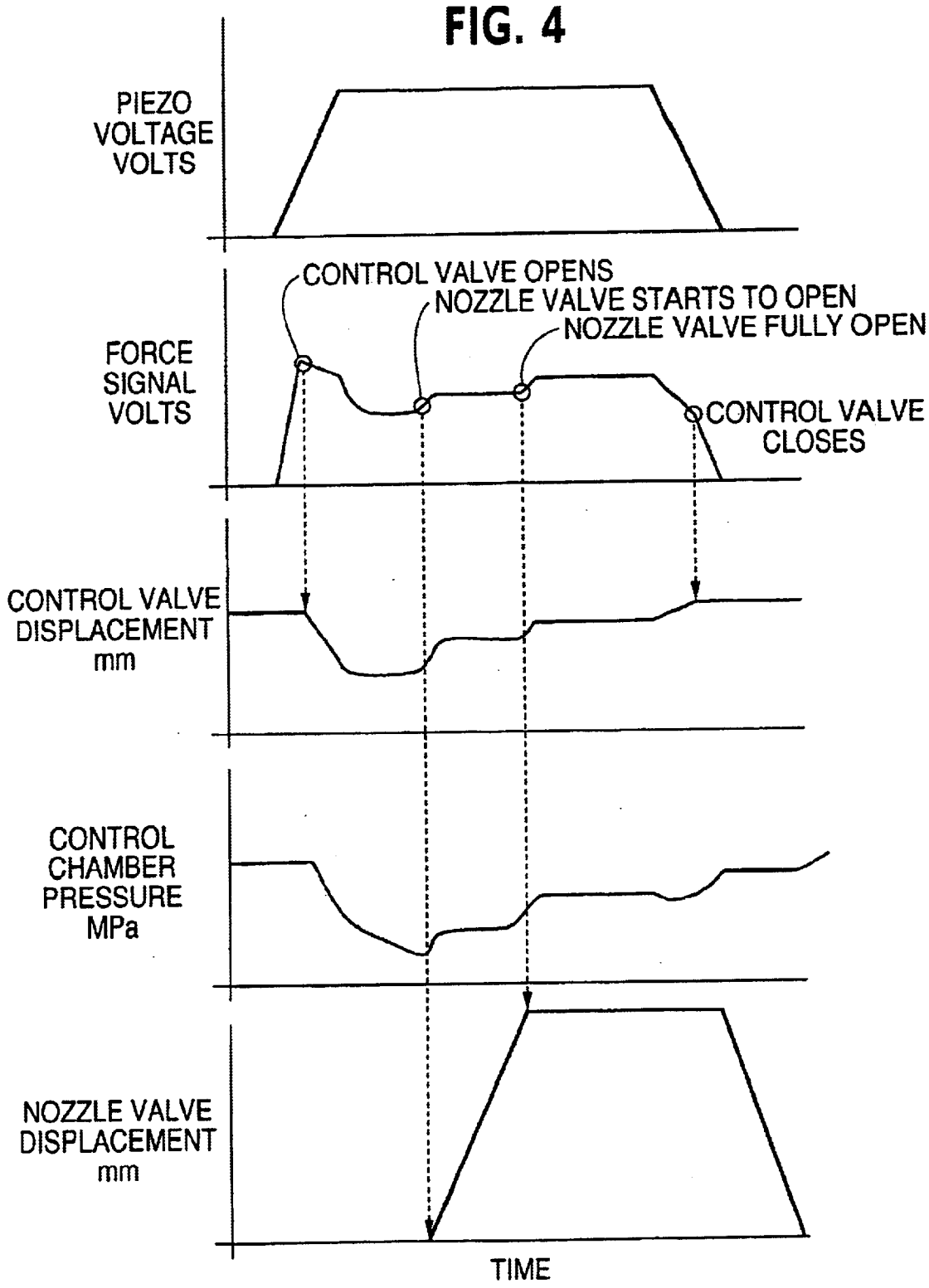
FIG. 4 is a graph of piezo drive voltage, force signal, control valve lift/displacement, control volume/chamber pressure and nozzle valve lift/displacement versus time showing the sensing of nozzle valve element movement and control valve member movement.

Importantly, fuel injector 10 also includes a nozzle valve element lift detecting device 100 for detecting the lift or extent of movement of nozzle valve element 18 into the open position and for producing a nozzle valve element lift feedback signal for enabling improved control over the movement of nozzle valve element 18. Specifically, nozzle valve lift detecting device 100 includes the relative positioning of the lower distal end of control valve member 60 relative to control volume 50 in such a manner to cause the variations in fuel pressure in control volume 50 to cause variations in fuel pressure forces on control valve member 60 and thus the force imparted to piezoelectric actuator 62, thereby affecting actuator voltage and permitting nozzle valve motion to be detected by monitoring piezoelectric actuator voltage. Specifically, by forming control valve member 60 such that the lower distal end forms the end wall of control volume 50, variations in control volume pressure and thus force on the control valve member 60, for example, due to movements of nozzle valve element 18, will be directly imparted to control valve member 60 and thus to actuator 62. When the fuel pressure in control volume 50 increases, the fuel pressure forces acting on the lower distal end of control valve member 60 increase thereby generating an axial force which is transmitted to piezoelectric actuator 62 causing compression of piezoelectric elements and generation of voltage. The increase in voltage due to an increase in fuel pressure forces acting on control valve element 60 causes a noticeable change in the voltage curve as shown in FIG. 4, for example, as nozzle valve element 18 begins to open so as to compress fuel and control volume 50. Thus, the increase in voltage functions as a nozzle valve element lift feedback signal which is detected by control device 67. Control device 67 may then process and utilize the nozzle valve element lift feedback signal in an appropriate manner to vary the timing of the injection control signal and/or the amount of voltage supplied to actuator 62 to thereby variably control the injection timing, fuel metering and/or injection rate shape. For example, if the opening response time of nozzle valve element 18 does not fall within predetermined limits, the voltage wave form applied to piezoelectric actuator 62 is adjusted by control device 67. Specifically, if the detected response time between actuation of actuator 62 and the detectable increase in the force signal due to opening of the nozzle valve element 18 is less than a predetermined target value, the voltage applied to piezoelectric actuator 62 would be reduced for the next injection event. Likewise, if the detected response time is greater than a predetermined target value, the piezo voltage would be increased for the next injection event to thereby reduce the response time of the opening of nozzle valve element 18.

It should be noted that fuel injector 10 also is capable of effectively detecting the opening and closing of control valve member 60 and providing a control valve member position feedback signal for optimizing control of the valve. Specifically, a portion of, or the entire set of, piezoelectric elements of actuator 62 may be monitored and detected by control device 67 for variations in the piezo voltage in either the entire stack or portion thereof. Alternatively, a dedicated force transistor, for example, a set of piezoelectric elements separate from actuator 62, may be used. The portion of the piezoelectric element or the separate force transistor may be connected to control device 67 using separate connections. Control device 67 detects the opening or unseating, and the closing or seating, of control valve member 60 and provides a control valve member position feedback signal for enabling improved control over the movement of control valve member 60 and thus nozzle valve element 18. Specifically, control device 67 senses the change in voltage in the piezoelectric elements due to a change in the force on the piezoelectric elements resulting from the movement of the control valve off its seat and returning back to its seat. Referring to FIG. 4, during opening of control valve member 60, the drive voltage is applied to actuator 62 causing a buildup in the force between the piezoelectric elements and the control valve member 60 until the force overcomes the fuel pressure forces acting on the portion of control valve member 60 exposed to the fuel in control volume 50 when the valve member is in the closed position. When the force applied by piezoelectric elements against control valve member 60 overcomes the fuel pressure forces tending to close control valve member 60, the control valve member unseats or lifts from its seat into an open position as indicated in FIG. 4. Almost immediately upon opening, the pressure in control volume 50 drops significantly while, in addition, higher pressure fuel acts on the opposite, low pressure side of control valve member 60 adjacent valve seat 70 thereby decreasing the total fuel pressure induced forces tending to close the valve. This decrease in the force acting against control valve member 60 causes a slight decrease in the load on the piezoelectric elements thereby causing a decrease in piezo sensor force measured in volts as indicated in FIG. 4. This voltage decrease is detected by control device 67. Similarly, when control valve member moves from the open position into the closed position as indicated in FIG. 4, the impact of control valve member 60 against its valve seat causes an increase in the reduction rate of the force signal. Thus, another control valve member position feedback signal is created and then detected by control device 67. Control device 67 may then process and utilize the control valve member feedback signals in an appropriate manner to vary the timing of the injection control signal and/or the amount of voltage supplied to actuator 62 to thereby variably control the injection timing, fuel metering and/or injection rate shape.

Figure 2:
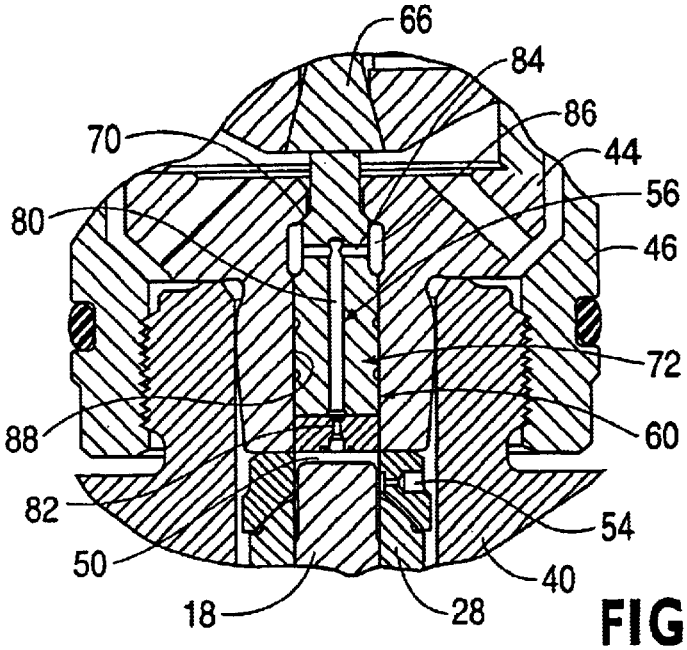
FIG. 2 is an expanded cross sectional view similar to FIG. 1*b* but with the control valve member in the open position.
Figure 3B:
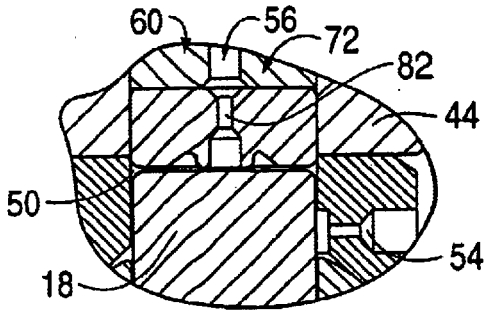
FIG. 3*b* is an expanded cross sectional view of the area C in FIG. 3*a;*
Figure 3A:
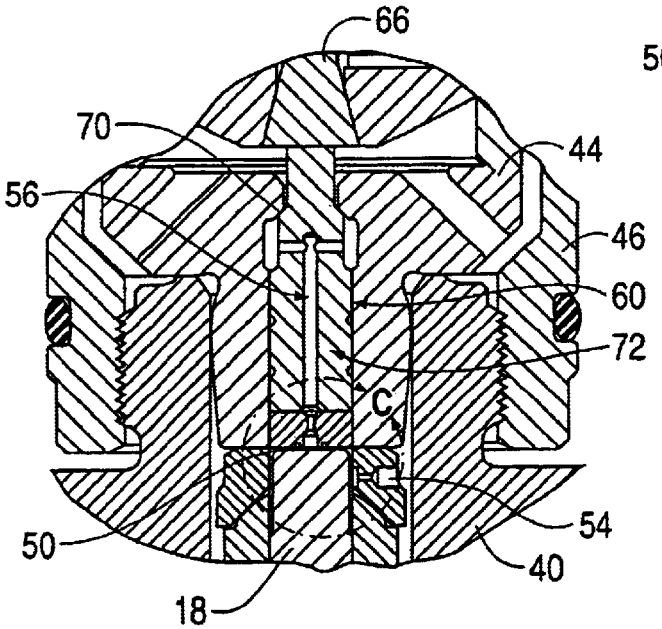
FIG. 3*a* is an expanded cross sectional view similar to FIG. 2 but with the nozzle valve element in an open position.
Figure 3C:
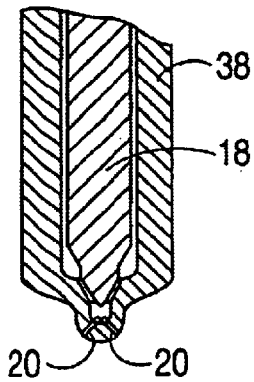
FIG. 3*c* is an expanded cross sectional view similar to FIG. 1*c* but with the nozzle valve element in the open position corresponding to FIG. 3*a;*

The advantages of the present invention can be more fully appreciated from the following description of the operation of fuel injector 10. Referring to FIGS. 1*a* through 1*c*, during operation, prior to an injection event, injection control valve 58 is de-energized causing control valve member 60 to be biased by fuel pressure forces acting on the lower distal end of control valve member 60 due to the high pressure fuel in control volume 50 into the closed position in sealing engagement against valve seat 70. The fuel pressure level experienced in the injector cavity surrounding nozzle valve element 18 is also present in control volume drain circuit 56 and control volume 50 since drain flow through drain circuit 56 is blocked by control valve member 60. As a result, the fuel pressure acting inwardly on nozzle valve element 18, in combination with the bias force of spring 22 maintain nozzle valve element 18 in its closed position blocking flow through injector orifices 20. At a predetermined time during the supply of high pressure fuel to high pressure fuel supply passage 26, actuator 62 is energized to controllably move control valve member 60 from the position shown in FIG. 1*b* to an open position shown in FIG. 2. The movement of control valve member 60 follows a predetermined lift schedule which varies the rate of movement of control valve member 60 so as to control the distance between control valve member 60 and valve seat 70 thus varying the drain flow from control volume 50 which ultimately permits precise control over the movement of nozzle valve element 18 between its closed and open positions. As control valve member 60 is lifted from valve seat 70, fuel flows from control volume 50 through drain circuit 56 to the low pressure drain. Simultaneously, high pressure fuel flows from control volume charge circuit 54 and the associated orifice into control volume 50. However, since the control volume charge circuit orifice is designed with a smaller cross sectional flow area than drain orifice 82, a greater amount of fuel is drained from control volume 50 than is replenished via control volume charge circuit 54. As a result, the pressure in control volume 50 immediately decreases. This decrease in fuel pressure in control volume 50 causes a measurable decrease in the force signal detected from actuator 62 by control device 67 thereby indicating control valve opening as shown in FIG. 4. As a result of the decreasing control volume pressure, fuel pressure forces acting on nozzle valve element 18 due to high pressure fuel in injector cavity 14, begin to move nozzle valve element 18 outwardly against the bias force of spring 22. This outward movement of the valve element 18 results in a slight increase in the fuel pressure in control volume 50 and thus an increase in the force signal from actuator 62 as detected by control device 67, thereby providing an indication of the opening of nozzle valve element 18 as shown in FIG. 4. Nozzle valve element 18 continues its outward movement until it reaches a hovering position in close proximity to the lower distal end of control valve member 60 as shown in FIGS. 3*a*–3*c*. Importantly, as nozzle valve element 18 approaches the lower distal end of control valve member 60, the fuel flow out of control volume 50 into drain circuit 56 is restricted by the outer end of needle valve element 18, thereby increasing control volume pressure resulting in an increase in the force acting on the piezoelectric elements of actuator 62. Thus, by monitoring the charge of a dedicated sensor layer contained in the piezoelectric stack of elements, an indication of the point in time when nozzle valve element 18 reaches its fully opened position, can be detected by control device 67 as shown in FIG. 4 where nozzle valve element 18 has reached the fully opened position. Of course, control device 67 may monitor a dedicated sensor layer contained in the stack of piezoelectric elements of actuator 62 or by monitoring the piezoelectric actuator voltage of a current or charge type driver. Therefore, the present invention effectively permits monitoring and sensing of the timing of control valve member opening, the start of nozzle valve element opening and the point at which nozzle valve element 18 reaches the fully open position (FIG. 3*c*). This control valve member and needle valve element motion detection can be used by control device 67 to correct for hardware variation and wear, and for diagnostic and prognostic information. Thus, the force imparted to actuator 62 by the fuel pressure acting on control valve member 60 effectively stabilizes the valve position at partial opening so that the control chamber outlet restriction is made variable enabling improved control over the injection rate shape. The force on actuator 62 also provides an indication of the control chamber pressure which provides information about the pilot valve and the injector nozzle valve element 18 resulting in a useful feedback signal for the electronic controls.

The present invention has several advantages over existing injector designs. First, by positioning valve seat 70 a spaced distance from control volume 50 and forming control valve member 60 with elongated portion 72 having the lower distal end forming an end wall of control volume 50, the design of the present invention is more sensitive to pressure changes in control volume 50 to create a greater correlation between changes in control volume pressure and corresponding changes in the force placed on the piezoelectric elements of actuator 62 by control valve member 60. In previous designs it was difficult to detect the opening of nozzle valve element 18 because the valve seat was positioned at the control volume where the flow through the valve seat was so large that a decrease in volume due to the outward movement of needle valve element 18 did not result in an increase in control volume pressure since fuel merely flowed through the valve seat to compensate for the volume decrease. The present design requires the fuel in control volume 50 to directly impart fuel pressure forces to control valve member 60 upstream of drain orifice 82. By combining this positioning of the control valve member 60 with the formation of drain circuit 56 in a position such that the nozzle valve element 18 restricts the flow through drain circuit 56 when moving into an open position, the present designs permits the detection of both the beginning of the opening of nozzle valve element 18 and the reaching of the fully open position of nozzle valve 18. The conventional prior designs often resulted in the control valve member having a large flow area and thus a small pressure drop across a valve seat positioned at the control volume causing the valve to uncontrollably open. The nozzle valve element may also uncontrollably contact the control valve member head upon opening. In the conventional design, this contact between the needle valve element and the head of the control valve member created control valve opening oscillations resulting in unstable valve operation, inadequate feedback signals and undesirable injector operation. However, in the present design, with valve seat 70 positioned a spaced distance from control volume 50 and drain orifice 82 reducing the pressure in drain circuit 56 adjacent valve seat 70 when control valve member 60 is moved into the open position, greater control over the movement of control valve member 60 is achieved thereby creating a more stable valve operation. In previous designs, the seat diameter positioned at the control volume and the rail pressure determined the force required to unseat a control valve member. Once unseated, the force on the control valve member decreases dramatically making control over the valve member position difficult. However, in the present design, although the seat diameter and rail pressure determine the force to unseat control valve member 60, the relative size of the orifice 82 and the guide diameter, that is, the diameter of control valve member 60 adjacent guide surface 88, maintains a high pressure in control volume 50 thereby creating and maintaining a greater force on control valve member 60 to provide greater stability and control. This creates a tunable design whereby the force maintained on the valve can be varied by varying the relative size of orifice 82 and the guide diameter.

Figure 5:
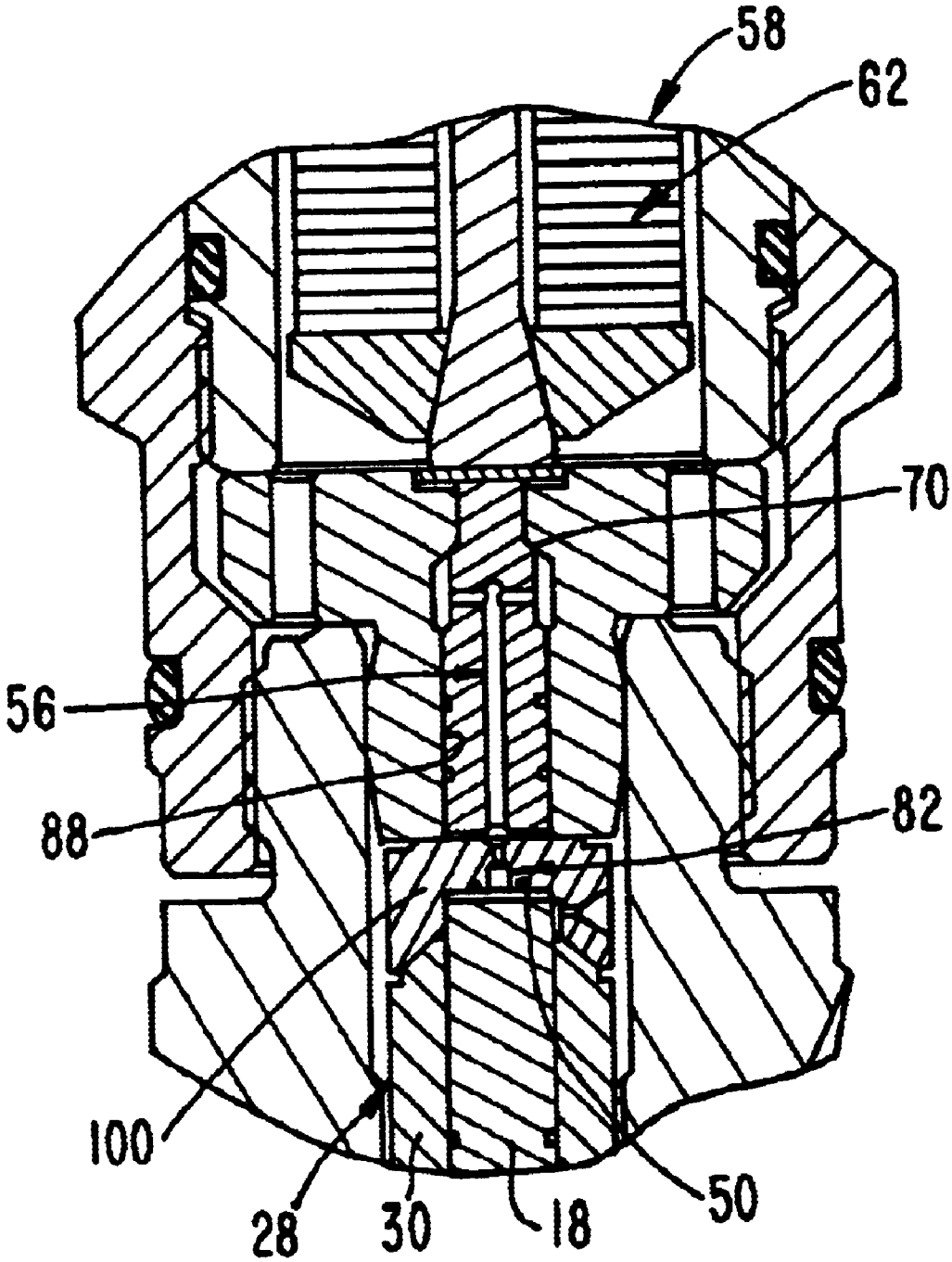
FIG. 5 is an expanded cross sectional view of a portion of a fuel injector in accordance with a second embodiment of the present invention.

FIG. 5 illustrates a second embodiment of the present invention which is similar to the previous embodiment and, in that respect, the same or similar components will be referred to with the same reference numerals used in the previous embodiment. The present embodiment of FIG. 5 includes a guide sleeve 28 having a first section 30, as in the previous embodiment, but including a second section 100 extending around the outer end of nozzle valve element 18 so as to form control volume 50. As a result, drain orifice 82 is integrally formed in the stationary second section 100 instead of being formed in the movable control valve member 60. The description above relating to the operation and advantages of the embodiment of FIG. 1 equally apply to the present embodiment except that no feedback relating to the position of the nozzle valve element, nor active valve control, is provided. By moving the drain orifice 82 from control valve member 60 to the stationary second section 100, the force acting on control valve member 60 and actuator 62 when the valve is open is greatly reduced. This reduction results in a larger valve opening for the same size piezo actuator. The larger valve opening at valve seat 70 is desirable when there is no feedback control or active rate shaping, so that the relatively smaller flow area of the fixed outlet orifice is the "controlling" orifice. As a result, any slight changes in valve flow area due to, for example, changes in piezo performance caused by, for example, temperature changes, will have an insignificant effect on injector performance.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection control by a simple control device in order to minimize emissions. Such internal combustion engines including a fuel injector in accordance with the present invention can be widely used in all industrial fields, commercial and noncommercial applications, including trucks, passenger cars, industrial equipment, stationary power plants and others.

We claim:

1. A fuel injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain, said drain circuit including a drain orifice for restricting drain flow;

a valve seat positioned along said drain circuit;

an injection control valve positioned along said drain circuit to control fuel flow from said control volume, said injection control valve including a reciprocally mounted control valve member movable between an open position permitting flow through said drain circuit and a closed position in sealing abutment against said valve seat to block flow through said drain circuit, said control valve member including an elongated portion extending from a position adjacent said valve seat toward an upstream portion of said drain circuit, said elongated portion of said control valve member including a first section for engaging said valve seat and a second section formed separately from, and positioned in abutment with, said first section, said second section containing said drain orifice; and a guide surface formed on said injector body and positioned adjacent said elongated portion of said control valve member to permit relative sliding movement of said elongated portion while guiding said elongated portion.

2. The injector of claim 1, wherein said elongated portion extends axially along said fuel injector body toward said control volume, said guide surface being cylindrically shaped.

3. The injector of claim 2, wherein said elongated portion is cylindrically shaped.

4. The injector of claim 1, wherein said elongated portion extends to a position adjacent said control volume and forms at least a portion of an end wall forming said control volume.

5. The injector of claim 1, wherein said drain circuit further includes a central passage formed in said control valve member having a first end positioned in communication with said control volume.

6. The injector of claim 5, wherein said drain circuit further includes a transverse passage formed in said control valve member in communication with both a second end of said central passage and an annular cavity surrounding said control valve member.

7. The injector of claim 1, wherein said guide surface and said elongated portion form a partial fluid seal to minimize leakage while permitting smooth reciprocal movement of said control valve member.

8. The injector of claim 1, further including a nozzle valve element lift detecting means for detecting movement of said nozzle valve element into said open position and for providing a nozzle valve element lift feedback signal.

9. The injector of claim 8, wherein said nozzle valve element lift detecting means includes a piezoelectric element.

10. The injector of claim 1, wherein said injection control valve further includes a piezoelectric actuator connected to said control valve member.

11. The injector of claim 8, further including a control means for receiving said nozzle valve element lift feedback signal and generating an injection control signal based on said nozzle valve element lift feedback signal.

12. The injector of claim 11, wherein said control means varies said injection control signal based on said nozzle valve element lift feedback signal to vary at least one of a timing of an opening of said injection control valve and a rate of opening of said injection control valve.

13. A fuel injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain, said drain circuit including a drain orifice for restricting drain flow;

a valve seat positioned along said drain circuit a spaced distance from said control volume; and an injection control valve positioned along said drain circuit and including a reciprocally mounted control valve member movable toward an outer end of said nozzle valve element into an open position permitting flow through said drain circuit and away from said nozzle valve element into a closed position against said valve seat, said control valve member including an elongated portion extending from a position adjacent said valve seat to a position adjacent said control volume, said elongated portion including a distal end forming an end wall of said control volume, said elongated portion of said control valve member including a first section for engaging said valve seat and a second section formed separately from, and positioned in abutment with, said first section, said second section containing said drain orifice.

14. The injector of claim 13, wherein said drain circuit includes a central passage having a first end positioned in communication with said control volume.

15. The injector of claim 14, wherein said drain circuit further includes a transverse passage in communication with both a second end of said central passage and an annular cavity surrounding said control valve member.

16. The injector of claim 13, further including a guide surface formed on said injector body and positioned adjacent said elongated portion of said control valve member to permit relative sliding movement of said elongated portion while guiding said elongated portion, wherein said guide surface and said elongated portion form a partial fluid seal to minimize leakage while permitting smooth reciprocal movement of said control valve member.

17. The injector of claim 13, further including a nozzle valve element lift detecting means for detecting movement of said nozzle valve element into said open position and for providing a nozzle valve element lift feedback signal, further including a control means for receiving said nozzle valve element lift feedback signal and generating an injection control signal based on said nozzle valve element lift feedback signal.

* * * * *